United States Patent [19]

Eyerly

[11] 4,324,301

[45] Apr. 13, 1982

[54] BUMPER CAR AMUSEMENT RIDE

[76] Inventor: Jon V. Eyerly, 3544 - 12th St. SE., Salem, Oreg. 97302

[21] Appl. No.: 120,661

[22] Filed: Feb. 29, 1980

[51] Int. Cl.[3] ..... B60L 9/00; B60M 1/00

[52] U.S. Cl. ..... 180/2 R; 104/53; 191/13; 191/29 R; 191/49; 293/107; 293/127

[58] Field of Search ..... 180/2 R, 307, 308, 65 E, 180/65 R; 104/53, 304; 191/13, 22 C, 22 DM, 29 R, 29 DM, 45 R, 49; 293/107, 108, 127; 428/137; 52/389, 391, 411, 598

[56] References Cited

U.S. PATENT DOCUMENTS

| | | | |
|---|---|---|---|
| 1,380,759 | 6/1921 | Whitaker | 293/107 |
| 1,452,432 | 4/1923 | Miller | 52/598 |
| 1,534,978 | 4/1925 | De Warloff | 180/2 R |
| 1,669,104 | 5/1928 | Stock | 180/2 R |
| 2,165,743 | 7/1939 | Bland | 191/13 |
| 3,135,069 | 6/1964 | Schuller | 52/411 |
| 3,424,260 | 1/1969 | Stone et al. | 180/65 R |
| 3,885,502 | 5/1975 | Sarno et al. | 104/53 |
| 3,978,934 | 9/1976 | Schneidinger et al. | 180/2 R |

FOREIGN PATENT DOCUMENTS

| | | | |
|---|---|---|---|
| 79591 | 11/1962 | France | 180/2 R |

*Primary Examiner*—David M. Mitchell
*Attorney, Agent, or Firm*—Oliver D. Olson

[57] ABSTRACT

A bumper car amusement ride includes a floor to which is adhesively bonded over their entire under surfaces a plurality of elongated electrically conductive plates separated by electrically non-conductive strips and with adjacent plates connected across a source of alternating current. A bumper car is supported for movement over the plates and strips by a pair of laterally spaced drive wheels and a pair of longitudinally spaced caster wheels, each of the drive wheels being coupled to the reversible, variable speed output of a hydrostatic transmission, the inputs of which are both coupled to the output of a direct current constant speed electric motor. The motor is connected through a rectifier to a plurality of contacts mounted on the car for sliding engagement with the floor plates.

13 Claims, 8 Drawing Figures

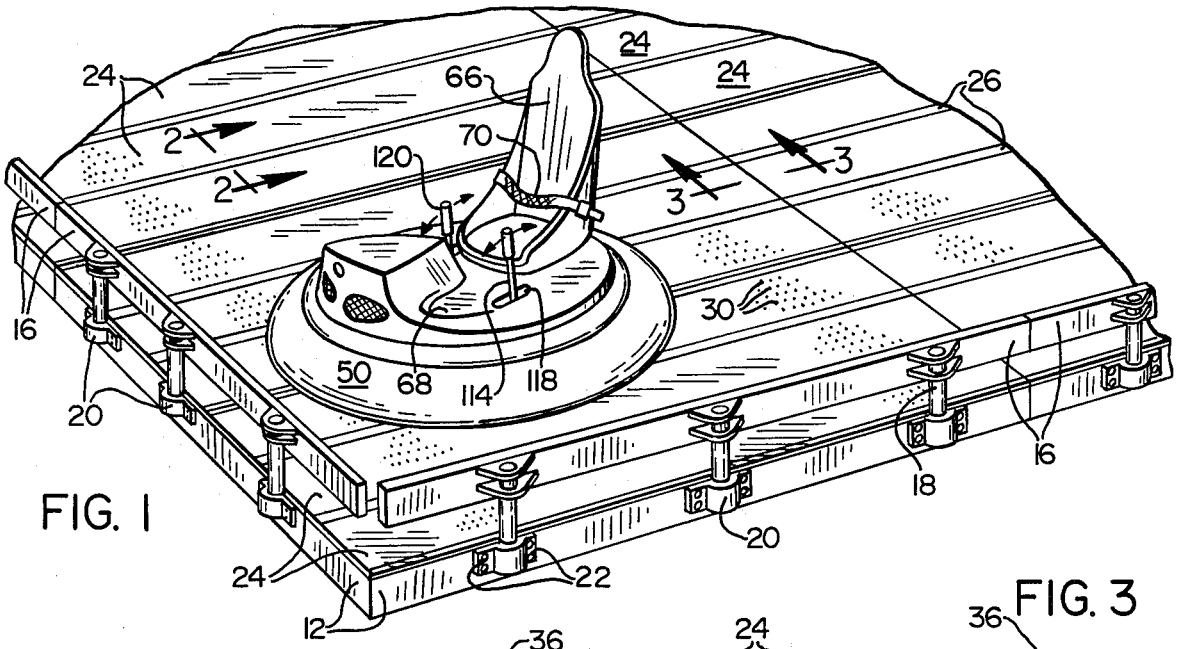
FIG. 1
FIG. 2
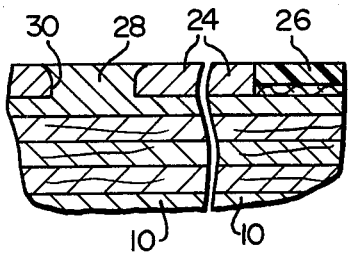
FIG. 3
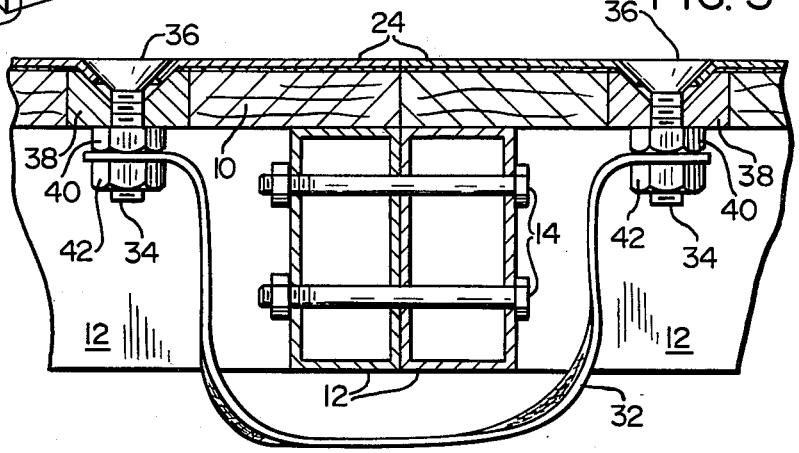
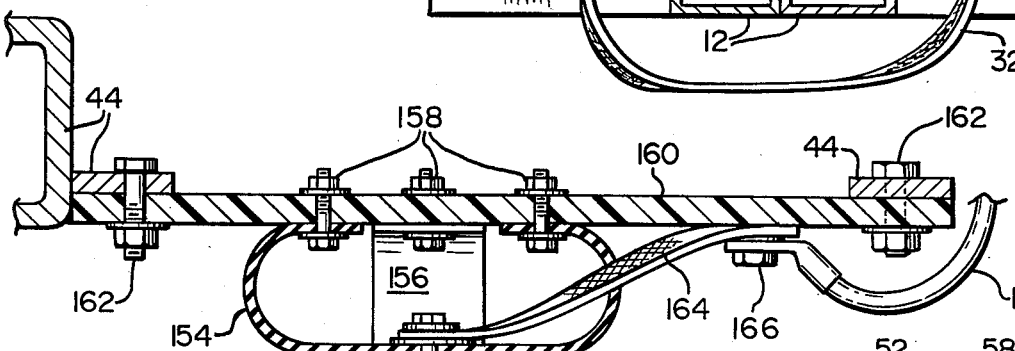
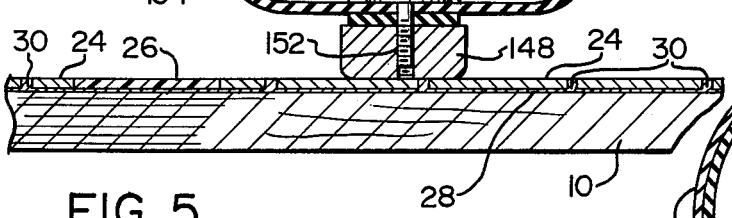
FIG. 5
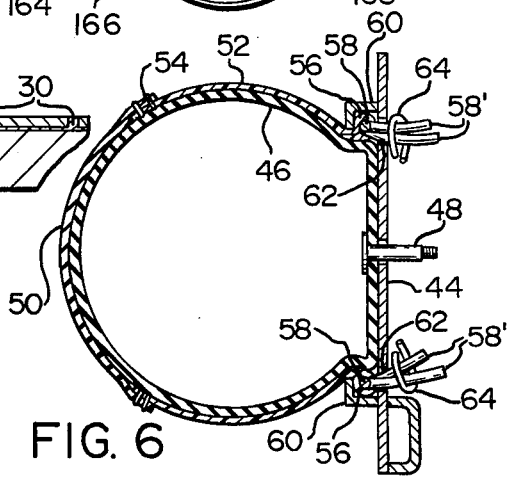
FIG. 6

BUMPER CAR AMUSEMENT RIDE

BACKGROUND OF THE INVENTION

This invention relates to amusement rides, and more particularly to an electrically actuated bumper car amusement ride in which the source of electric power is delivered to the bumper car through the supporting floor.

Electrically operated bumper car amusement rides have been disclosed heretofore, as exemplified by U.S. Pat. No. 3,885,502 in which direct current is applied to electrically spaced conductor plates on the floor for operating a direct current drive motor on the bumper car through an on-off foot switch, and U.S. Pat. No. 3,978,934 in which alternating current is applied to electrically spaced conductor plates on the floor and is rectified to direct current on the bumper car for operating a direct current drive motor on the bumper car through electronic control circuits operated by a foot throttle.

SUMMARY OF THE INVENTION

In its basic concept, the bumper car amusement ride of this invention utilizes a single, constant speed direct current motor to drive a pair of reversible, variable speed hydrostatic transmissions coupled independently to a pair of drive wheels on a bumper car.

A principal objective of this invention is to provide a bumper car amusement ride of improved efficiency, economy and versatility of operation.

Another object of this invention is the provision of a bumper car amusement ride of the class described in which the car supporting floor includes electrically spaced conductor plates and insulator strips bonded adhesively over their entire under surfaces to an underlying base floor, whereby to insure continuous engagement therewith of electrical contacts carried by the car.

A further object of this invention is the provision of a bumper car amusement ride of the class described in which a predetermined relationship between the width of the conductor plates and the spacing between the electrical contacts on the car insures positive operation during all maneuvers of the car over the floor.

Still another object of this invention is the provision of a bumper car amusement ride which is of simplified construction for economical manufacture, requiring minimum maintenance and repair.

The foregoing and other objects and advantages of this invention will appear from the following detailed description, taken in connection with the accompanying drawings of a preferred embodiment.

BRIEF DESCRIPTION OF THE DRAWINGS

FIG. 1 is a fragmentary perspective view of a bumper car amusement ride embodying the features of this invention.

FIG. 2 is a fragmentary vertical section taken on the line 2—2 in FIG. 1 showing the bonding of the conductor plates and insulator strips to an underlying support floor.

FIG. 3 is a fragmentary vertical section taken on the line 3—3 in FIG. 1 showing the electrical connection between conductor plate sections of floor modules.

FIG. 5 is a fragmentary vertical section taken on the line 5—5 in FIG. 4 showing the resilient mounting of one of the electrical contacts on the car frame.

FIG. 6 is a fragmentary vertical section taken on the line 6—6 in FIG. 4 showing the structural arrangement of the resilient peripheral bumper of the car.

DESCRIPTION OF THE PREFERRED EMBODIMENT

Figure 4:
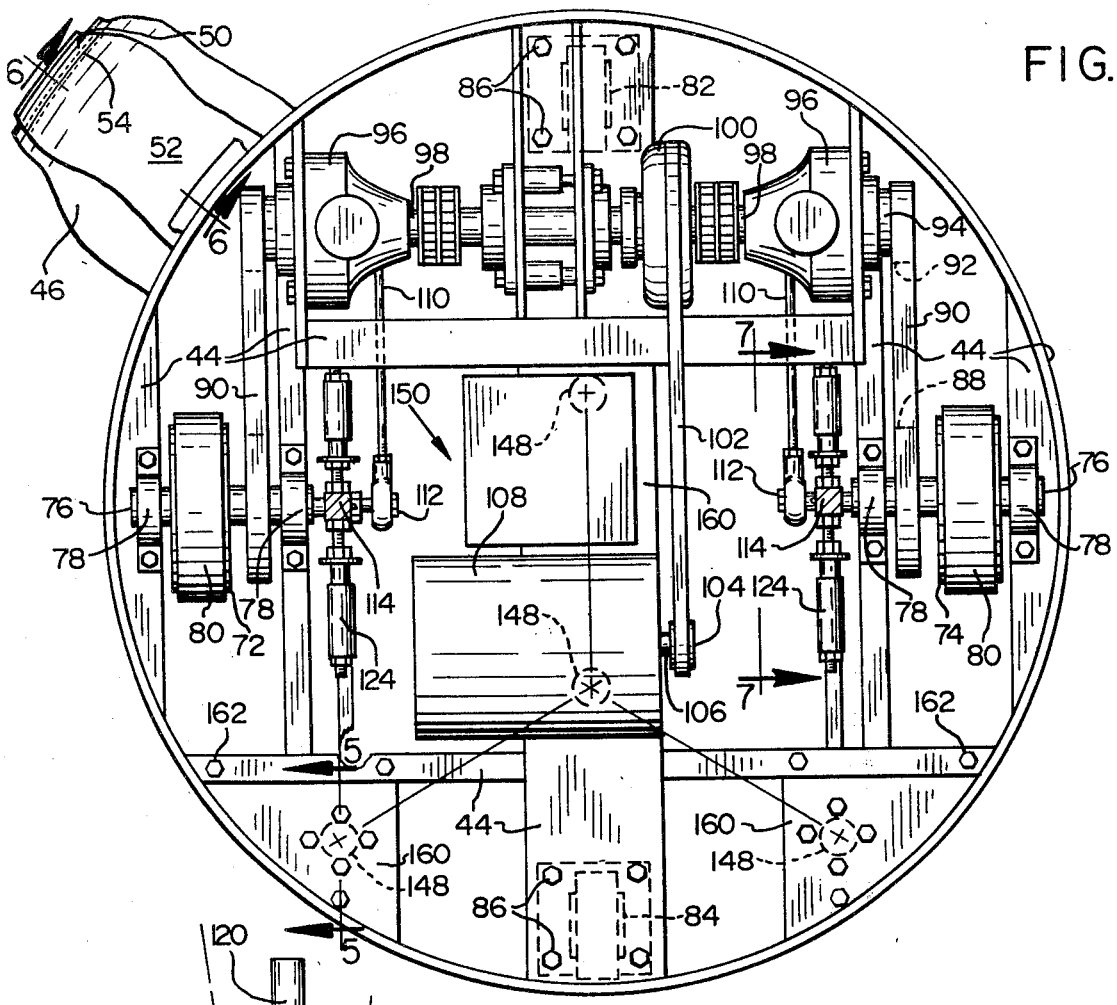
FIG. 4 is a plan view of the bumper car shown in FIG. 1, the upper body portion and peripheral bumper being removed to disclose internal structural details.

The bumper car amusement ride of this invention includes a car-supporting floor 10 of electrically non-conductive material. As illustrated in FIG. 1, the amusement ride is made up of an assembly of interconnected modules, and therefore the floor includes a plurality of sections. A preferred form of floor is made of sections of high density, exterior grade plywood. Each section is reinforced structurally by a perimeter framework of metal tubing 12 secured to the bottom side of the plywood. The tubings associated with the interior confronting edges of adjacent floor sections may serve to join the sections together to form the completed floor, as by means of bolts 14 extended through registering openings in the tubings.

The reinforcing tubings associated with the edges of the floor sections which define the outer perimeter of the completed floor, serve to support a perimeter bumper rail by which to confine the bumper cars to the operating surface of the ride. As illustrated, the perimeter rail is provided by a plurality of lengths of beams 16 supported at longitudinally spaced intervals by rods 18 which extend vertically upward from sockets 20 secured to the reinforcing tubings by bolts 22 extended through openings in the tubings. The spacings of these openings are the same as the spacings of the openings in the interior tubings, whereby all floor sections are rendered interchangeable and usable in diverse patterns.

Each of the floor sections supports a plurality of electrically conductive, laterally spaced, elongated metal plates 24. Adjacent plates are separated electrically by means of an electrically non-conductive spacer strip 26.

In accordance with this invention, the metal plates and spacer strips are secured to the floor section in such a way as to to preclude warping of the plates and strips, or otherwise prevent portions of the plates and strips from moving vertically relative to the floor. Thus, the plates and strips are bonded securely to the floor by means of an electrically non-conductive adhesive layer 28 which covers substantially the entire upper surface of the floor and the undersides of the plates and strips.

To insure against any possibility of the metal plates becoming loosened from the underlying floor, the plates are provided with a multiplicity of openings 30 into which some of the adhesive may extend. In the preferred embodiment illustrated, the openings in the plates are flared somewhat (FIG. 2) to larger diameter at the upper side of the plates. In this manner, adhesive extruded into such flared openings functions effectively to secure the metal plates against vertical movement.

In the preferred embodiment illustrated, the undersides of the non-conductive strips 26 have a layer of roving material bonded thereto, or are otherwise roughened to allow the adhesive to extend upward into the voids or channels thus provided.

By securely bonding the conductive metal plates and the non-conductive strips to the underlying floor, throughout substantially their entire areas, there is prevented any relative movement of the plates and strips at their abutting edges, whereby the car-supporting surface is maintained perfectly flat. The possibility of intermittent operation of the cars thus is avoided.

It is to be noted from FIG. 1 of the drawings that the electrically conductive plates and electrically non-conductive insulator strips of adjacent modules are in longitudinal alignment. Electrical continuity between metal plates forming longitudinal extensions of each other, is provided by an electrically conductive connector strap 32 (FIG. 3) which is secured at its opposite ends to the adjacent metal plates. In the preferred embodiment illustrated, positive attachment of each end of the connector strap is provided by a special connector illustrated. This includes a bolt having a threaded shank 34 and a head 36 of truncated conical shape extending from the shank. A sleeve 38 is provided with a central bore to receive the bolt shank, and an outer portion of the sleeve bore is of truncated conical shape substantially matching the bolt head.

A hole is provided in the electrically conductive metal plate 24 for reception of the bolt shank downwardly therethrough. The sleeve then is slipped onto the bolt shank on the underside of the plate, after which a clamp nut 40 is threaded onto the bolt shank and tightened down. This draws the bolt head and sleeve toward each other, whereby the metal plate interposed between them is swaged into the space between the bolt head and sleeve. This forms a positive electrical connection between the conductive plate and the bolt shank. It is to be noted that the upper surface of the bolt head 36 is disposed in the plane of the upper surface of the metal plate 24 and thus forms a continuation thereof.

The associated end of the connector strap 32 is provided with a hole through which to receive the downwardly projecting end portion of the bolt shank, whereupon a second nut 42 is threaded onto the bolt shank and tightened against the strap. The elongated electrically conductive plates 24 are arranged to be connected to a source of alternating current, as explained more fully hereinafter.

The assembled modules which form the playing surface of the amusement ride, preferably are supported above ground by means of an underlying support framework (not shown) capable of being adjusted to accommodate variations in ground levels, as will be understood.

The bumper car amusement ride includes a plurality of bumper cars arranged to be maneuvered over the surface of the floor-supported plates 24 and strips 26. Each of the cars includes a frame 44 upon which the operating components of the car is mounted. In the embodiment illustrated, the frame has a circular peripheral wall which mounts an annular resilient bumper. The preferred bumper illustrated comprises an annular flexible tube 46 (FIG. 6) capable of being inflated with air, as by means of the air valve 48 which extends inwardly through an opening in the peripheral wall of the frame.

The tube 46 is enclosed in a flexible protective cover. As illustrated, the outer peripheral section 50 of the cover is made of wear resistant rubber, while the inner annular section 52 is made of synthetic thermoplastic resin, preferably of the vinyl type. These sections are secured together in lapped arrangement by a line of thread stitching 54.

The inner peripheral upper and lower edges of the inner section 52 are doubled back upon themselves and heat sealed or otherwise secured together to form upper and lower annular bead loops 56. An opening is formed in the side of each loop and a length of flexible cable or other form of cinch cord 58 is threaded through the loop, the end portions 58' of the cord projecting outward through said opening.

Upper and lower bead confining members preferably are provided on the peripheral wall 44 to prevent vertical displacement of the bumper assembly therefrom. As illustrated, upper and lower angle irons 60 are secured to the outer surface of the frame wall, forming with the latter vertically spaced bead confining grooves which face each other. The upper and lower bead loops 56 fit into these grooves and are protected by the outwardly projecting flanges of the angle irons.

The end portions 58' of the cinch cords are pulled inward through openings 62 in the frame wall 44 to draw the bead loops 56 tightly around the frame wall. A clamp 64 then is secured to the cord ends adjacent the frame wall to prevent retraction of the cord ends outward through the openings 62 and consequent loosening of the bead loops. Air under pressure then is filled into the inner tube 46 to inflate it against the protective cover.

The frame also supports a body which projects upwardly from the upper side of the frame and includes a seat 66 in which to confine an occupant and foot wells 68 forwardly of the seat for receiving the feet of the occupant. A safety strap 70 on the seat insures retention of the operator to the seat.

The frame is supported by a plurality of wheels for movement over the assembly of conductive plates 24 and non-conductive strips 26. As best illustrated in FIG. 4 of the drawings, two of the wheels 72 and 74 are spaced apart laterally to opposite sides of the longitudinal center line of the frame and are secured to stub shafts 76 journaled in bearings 78 supported by spaced members of the frame. The wheels are provided with resilient traction treads 80 of electrically nonconductive rubber or other suitable material.

A pair of caster wheels 82 and 84 are also mounted on the frame, as by bolts 86, spaced apart longitudinally on the longitudinal, fore-and-aft center line of the frame. At least the circumferential surfaces of the caster wheels are made of electrically non-conductive material.

The laterally spaced wheels 72 and 74 are drive wheels by which the bumper car is moved over the floor plates. In the preferred embodiment illustrated, the stud shaft 76 of each wheel mounts a pulley 88 for a drive belt 90 which also engages a pulley 92 on the output rotary shaft 94 of a reversible, variable speed hydrostatic transmission 96 mounted on the frame 44. The input rotary shafts 98 of both transmissions are coupled together for simultaneous rotation. A pulley 100 also is secured to the input shaft of one of the transmissions and is coupled through a belt 102 to a pulley 104 on the output rotary shaft 106 of a single, constant speed direct current electric motor 108 mounted on the frame.

Figure 7:
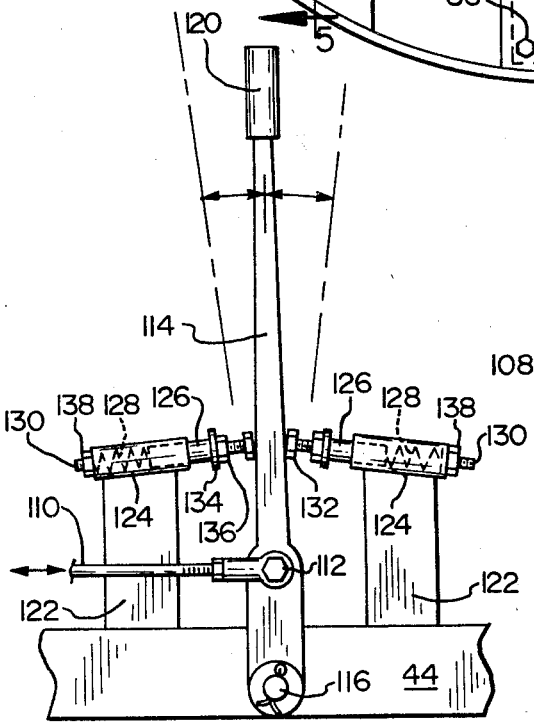
FIG. 7 is a fragmentary vertical elevation, as viewed in the direction of arrows 7—7 in FIG. 4, showing one of the drive control sticks of the bumper car.

The hydrostatic transmissions are of conventional design available commercially from a variety of sources. A control rod 110 extends from each transmission and is connected at its outer end by a pivot bolt 112 to an intermediate point on an elongated control stick 114 (FIG. 7). The bottom end of the control stick is mounted pivotally, by a pivot shaft 116, on the car frame, and the major upper portion of the control stick projects upwardly through a slot 118 (FIG. 1) in the car body for access by the operator of the car. For this purpose the upper end of the control stick is provided with a handle 120.

As best seen in FIG. 1 of the drawings, the two control sticks project upward through the body at laterally spaced positions to the opposite sides of the seat, for convenient access to the hands of the operator.

Means is provided for insuring that both hydrostatic transmissions return to a neutral position when the hands of the operator are removed from the control sticks. This is achieved in the embodiment illustrated, and best shown in FIG. 7, by a pair of spring loaded plungers mounted on the car frame and bearing resiliently against opposite sides of the control stick.

Specifically, a pair of standards 122 extend upward from the frame 44, and each mounts at its upper end a hollow cylinder 124. Extending slidably into the cylinder from the control stick end is a hollow plunger 126. A coil spring 128 within the cylinder abuts at one end against the cylinder and at the opposite end against the plunger, whereby to urge the plunger resiliently outward of the cylinder. The plunger has a bore therethrough which receives the threaded shank 130 of an abutment bolt the head 132 of which is disposed for abutment against the confronting side of the control stick. A washer 134 and nut 136 on the threaded shank of the bolt adjacent the head 132 serves to secure the latter in its position of longitudinal adjustment relative to the plunger 126.

The opposite end of the bolt shank extends through the opposite end of the cylinder and receives a stop nut 138 thereon for abutment against the adjacent end of the cylinder. By this means the headed ends of the opposed bolts may be adjusted to define the central position of the control stick illustrated in FIG. 7, which position corresponds to the neutral position of the associated transmission.

Figure 8:
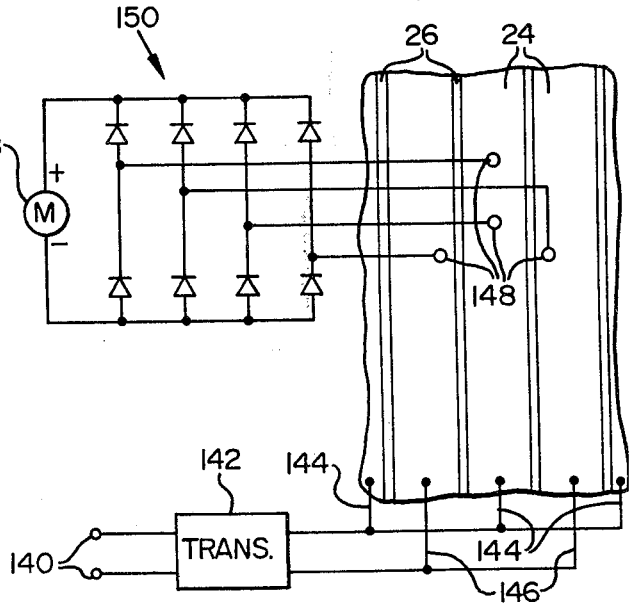
FIG. 8 is a schematic electrical diagram showing an arrangement of alternating and direct current supplies associated with the car-supporting conductor plates and insulator strips.

Means is provided for delivering direct current to the electric motor 108. Referring to FIG. 8 of the drawings, a source 140 of alternating current is connected to the plurality of electrically conductive metal plates, as previously explained. As illustrated, the source 128 is 220 volts alternating current and it is connected to the input terminals of a 24 volt alternating current transformer 142, the output terminals of which are connected alternately, as by conductors 144 and 146, to adjacent electrically conductive plates 24. These electrical connections to the conductive plates preferably are provided by the special connector bolt and sleeve assembly 34–42 illustrated in FIG. 3 and described hereinbefore.

A plurality of electrical contacts 148 are mounted on the bumper car for sliding engagement with the electrically conductive plates, as described more fully hereinafter. These electrical contacts also are connected through a rectifier 150 to the input terminals of the direct current motor, which, in the embodiment illustrated, is of 24 volts to match the output of the transformer 142.

Referring now primarily to FIG. 5 of the drawings, each of the electrical contacts 148 comprises an electrically conductive block of metal provided with a central threaded opening for the removable reception of the threaded shank 152 of a bolt. The bolt shank extends through registering openings in a pair of electrically non-conductive resilient straps 154 and 156 of belting rubber or other suitable material which are lapped one over the other intermediate their ends and disposed at right angles to each other. The opposite end portions of each strap are curved inwardly toward each other, whereby each strap is rendered substantially C-shape. The terminal end portions of the straps then are secured, as by bolts 158, to the underside of an electrically non-conductive support plate 160 secured to the car frame, as by bolts 162.

The shank 152 of the contact mounting bolt also extends through an opening in one end of an elongated flexible conductor strap 164 the opposite end of which is secured to the non-conductive plate 160, as by a terminal bolt 166. This bolt also extends through an opening in a terminal connector at one end of an electric conductor 168 the opposite end of which is connected to the rectifier 150.

The resilient mounting of the electrical contacts 148 allows a limited degree of tilting of the bumper car as it is maneuvered by the operator, whereby to maintain it in positive electrical engagement with the electrically conductive metal plates 24 of the floor.

Referring to FIGS. 4 and 8 of the drawings, there are four electrical contacts 148 provided for each car. As best illustrated in FIG. 4, the four contacts are arranged in the pattern of a Y and the distance between adjacent contacts is substantially the same as the width of the electrically conductive plates 24. Obviously the diameter of the contacts 148 is narrower than the width of the non-conductive strips 26, so as to prevent the contacts from shorting across adjacent conductive plates.

The Y pattern of the four electrical contacts insures that there always is at least two of the contacts engaging an adjacent pair of conductive plates, whereby to insure continuous delivery of electric potential to the drive motor 108.

In the operation of the bumper car amusement ride described hereinbefore, an operator positioned in the seat of the car grasps the handle ends of the two control sticks 114. If the operator pulls rearward on both control sticks, both hydrostatic transmissions operate to rotate both drive wheels 72 and 74 in the same direction to move the bumper car rearwardly. Conversely, movement of both control sticks in the forward direction functions to reverse the direction of rotation of the output shafts of the transmissions to propel the car in the forward direction. Moving one control stick in the rearward direction and the other in the forward direction functions to rotate the pair of drive wheels in opposite directions, whereby to cause the car to turn about its central vertical axis. The degree of movement of the control sticks in either direction functions to control the speed and direction of the car, as will be understood.

When the operator lets go of the control sticks, they return automatically to the neutral position of FIG. 7, corresponding to the neutral position of the hydrostatic transmissions. The bumper car thus is brought to a stop.

It will be apparent to those skilled in the art that various changes may be made in the size, shape, type, number and arrangement of parts described hereinbefore without departing from the spirit of this invention and the scope of the appended claims.

Having now described my invention and the manner in which it may be used, I claim:

1. A bumper car amusement ride, comprising:
(a) a floor,
(b) a plurality of electrically conductive, laterally spaced, elongated metal plates overlying the floor, the plates having a multiplicity of openings therethrough,
(c) an electrically non-conductive strip filling the space between each pair of adjacent laterally spaced conductive plates,
(d) an electrically non-conductive adhesive layer coating substantially the entire underside of the plates and strips bonding the latter to the floor, the adhesive extending upward into the openings in the plates,
(e) means for connecting adjacent plates across a source of alternating current,
(f) a bumper car including a frame, a pair of laterally spaced drive wheels mounted on the frame for axial rotation about substantially horizontal axes, and a pair of longitudinally spaced caster wheels mounted on the frame for axial rotation about substantially horizontal axes and for rotation about substantially vertical axes, the drive and caster wheels supporting the frame for movement over the conductive plates and non-conductive strips, and
(g) electrically activated drive means on the frame coupled to the drive wheels and electrically connected slidably to the conductive plates for its source of electric power.

2. The amusement ride of claim 1 wherein the multiplicity of openings in the plates are enlarged toward the upper sides of the conductive plates and the adhesive is filled into said openings substantially to said upper sides of the plates.

3. The amusement ride of claim 1 wherein the drive means comprises:
(a) four spaced electrical contacts mounted resiliently on the frame and extending downward therefrom for resilient sliding engagement with the plates and strips as the frame is moved thereover,
(b) a hydrostatic transmission mounted on the frame for each drive wheel, the transmission having an input and a reversible, variable speed output coupled to the associated drive wheel,
(c) a direct current electric motor on the frame coupled to the input of both transmissions,
(d) movable control means extending from each transmission for manipulation by an operator of the bumper car, each control means including means for returning it to a neutral position when released by an operator, whereby to return the associated transmission to neutral, and
(e) electric rectifier means having an input connected to the contacts and an output connected to the direct current electric motor.

4. In combination with a bumper car of a bumper car amusement ride, wherein the car has a frame which includes a peripheral wall, a resilient bumper for the car, comprising:
(a) an inflatable flexible tube surrounding the peripheral wall,
(b) an annular flexible protective cover overlapping the tube and having upper and lower annular bead loops on the upper and lower inner edges of the cover,
(c) a cinch cord extending through each of the annular bead loops with the ends of each cord pulled tightly inward through an opening in the peripheral wall of the car frame to draw the bead loops tightly against said peripheral wall, and
(d) means for securing the end portions of each cord against retraction outward through the peripheral wall.

5. The combination of claim 4 wherein each of the upper and lower edges portion of the cover is doubled back upon itself and secured to form a continuous annular cord-confining bead loop.

6. The combination of claim 4 including vertically spaced annular bead confining members on the outer side of the peripheral wall for confining the bead loops between them.

7. The combination of claim 6 wherein the bead confining members form with the peripheral wall bead confining annular grooves which face each other.

8. A bumper car amusement ride, comprising:
(a) a floor,
(b) a plurality of electrically conductive, laterally spaced, elongated metal plates overlying the floor, the plates having a multiplicity of openings therethrough,
(c) an electrically non-conductive strip filling the space between each pair of adjacent laterally spaced conductive plates, .
(d) an electrically non-conductive adhesive layer coating substantially the entire underside of the plates and strips bonding the latter to the floor, the adhesive extending upward into the openings in the plates,
(e) means for connecting adjacent plates across a source of alternating current,
(f) a bumper car including a frame, a pair of laterally spaced drive wheels mounted on the frame for axial rotation about substantially horizontal axes, and a pair of longitudinally spaced caster wheels mounted on the frame for axial rotation about substantially horizontal axes and for rotation about substantially vertical axes, the drive and caster wheels supporting the frame for movement over the conductive plates and non-conductive strips, the bumper car frame including a peripheral wall and a resilient bumper comprising:
(1) an inflatable, flexible tube surrounding the peripheral wall,
(2) an annular flexible protective cover overlapping the tube and having upper and lower annular bead loops on the upper and lower inner edges of the cover,
(3) a cinch cord extending through each of the tubular bead loops with the ends of each cord pulled tightly inward through an opening in the peripheral wall of the car frame to draw the bead loops tightly against said peripheral wall, and
(4) means for securing the end portions of each cord against retraction outward through the peripheral wall, and
(g) electrically activated drive means on the frame coupled to the drive wheels and electrically connected slidably to the conductive plates for its source of electric power.

9. The amusement ride of claim 8 wherein each of the upper and lower edge portions of the cover is doubled back upon itself and secured to form a continuous annular cord-confining bead loop.

10. The amusement ride of claim 8 including vertically spaced annular bead confining members on the outer side of the peripheral wall for confining the bead loops between them.

11. The amusement ride of claim 10 wherein the bead confining members form with the peripheral wall bead confining annular grooves which face each other.

12. A bumper car amusement ride, comprising:

(a) a floor, (b) a plurality of electrically conductive, laterally spaced, elongated metal plates overlying the floor, the plates having a multiplicity of openings therethrough, (c) an electrically non-conductive strip filling the space between each pair of adjacent laterally spaced conductive plates, (d) an electrically non-conductive adhesive layer coating substantially the entire underside of the plates and strips bonding the latter to the floor, the adhesive extending upward into the openings in the plates, (e) means for connecting adjacent plates across a source of alternating current, each connecting means including a bolt having a threaded shank and a head of truncated conical shape, a sleeve on the bolt shank having a portion of the central bore of truncated conical shape substantially matching the bolt head, and a nut on the threaded shank confining the sleeve between the head and nut, the electrically conductive plate being interposed between the bolt head and sleeve and having an opening receiving the bolt shank, whereby tightening of the bolt swages the plate between the bolt head and sleeve, and a second nut on the bolt shank securing an electrical conductor between the first and second nuts, (f) a bumper car including a frame, a pair of laterally spaced drive wheels mounted on the frame for axial rotation about substantially horizontal axes, and a pair of longitudinally spaced caster wheels mounted of the frame for axial rotation about substantially horizontal axes and for rotation about substantially vertical axes, the drive and caster wheels supporting the frame for movement over the conductive plates and non-conductive strips, and (g) electrically activated drive means on the frame coupled to the drive wheels and electrically connected slidably to the conductive plates for its source of electric power.

13. A bumper car amusement ride, comprising:

(a) a floor, (b) a plurality of electrically conductive, laterally spaced, elongated metal plates overlying the floor, the plates having a multiplicity of openings therethrough, (c) an electrically non-conductive strip filling the space between each pair of adjacent laterally spaced conductive plates, (d) an electrically non-conductive adhesive layer coating substantially the entire underside of the plates and strips bonding the latter to the floor, the adhesive extending upward into the openings in the plates, (e) means for connecting adjacent plates across a source of alternating current, (f) a bumper car including a frame, a pair of laterally spaced drive wheels mounted on the frame for axial rotation about substantially horizontal axes, and a pair of longitudinally spaced caster wheels mounted on the frame for axial rotation about substantially horizontal axes and for rotation about substantially vertical axes, the drive and caster wheels supporting the frame for movement over the conductive plates and non-conductive strips, and (g) electrically activated drive means on the frame coupled to the drive wheels and electrically connected slidably to the conductive plates for its source of electric power, the drive means comprising:

(1) four spaced electrical contacts mounted resiliently on the frame and extending downward therefrom for resilient sliding engagement with the plates and strips as the frame is moved thereover, the mounting means for each contact comprising a pair of substantially C-shaped resilient members disposed at substantially right angles to each other and one lapping the other at portions centrally thereof, the ends of the members being secured to the frame and the lapping portions mounting the electrical contact, (2) a hydrostatic transmission mounted on the frame for each drive wheel, the transmission having an input and a reversible, variable speed output coupled to the associated drive wheel, (3) a direct current electric motor on the frame coupled to the input of both transmissions, (4) movable control means extending from each transmission for manipulation by an operator of the bumper car, and (5) electric rectifier means having an input connected to the contacts and an output connected to the direct current electric motor.

* * * * *